US010300734B2

(12) United States Patent
Gonzalez

(10) Patent No.: US 10,300,734 B2
(45) Date of Patent: May 28, 2019

(54) SHEET MATERIAL DISPENSER FOR UTENSIL ITEM

(71) Applicant: Jose Luis Gonzalez, Houston, TX (US)

(72) Inventor: Jose Luis Gonzalez, Houston, TX (US)

( * ) Notice: Subject to any disclaimer, the term of this patent is extended or adjusted under 35 U.S.C. 154(b) by 75 days.

(21) Appl. No.: 15/433,809

(22) Filed: Feb. 15, 2017

(65) Prior Publication Data

US 2017/0165999 A1 Jun. 15, 2017

Related U.S. Application Data

(63) Continuation of application No. 14/695,635, filed on Apr. 24, 2015, now Pat. No. 9,604,491.

(60) Provisional application No. 61/983,595, filed on Apr. 24, 2014.

(51) Int. Cl.
*B43K 29/00* (2006.01)
*B43K 29/12* (2006.01)
*B43K 29/20* (2006.01)

(52) U.S. Cl.
CPC ..... *B43K 29/12* (2013.01); *B43K 29/20* (2013.01)

(58) Field of Classification Search
CPC ..... B43K 29/12; B43K 29/20
USPC ..... 401/195
See application file for complete search history.

(56) References Cited

U.S. PATENT DOCUMENTS

| | | | | |
|---|---|---|---|---|
| 1,322,966 | A | 11/1919 | Sinclair | |
| 1,595,900 | A | 8/1926 | Maas | |
| 2,991,952 | A | 7/1961 | Marchuck et al. | |
| 3,961,852 | A | 6/1976 | Parry | |
| 4,030,842 | A | 6/1977 | White et al. | |
| 4,812,069 | A | 3/1989 | White et al. | |
| 4,989,801 | A | 2/1991 | Thomas et al. | |
| D329,459 | S | 9/1992 | Sullivan | |
| D338,036 | S | 8/1993 | Sullivan | |
| 6,719,472 | B2 | 4/2004 | Windorski et al. | |
| 7,322,766 | B2 * | 1/2008 | Erlebacher | B43K 29/12 401/195 |
| 8,496,392 | B2 | 7/2013 | Windorski | |
| 2009/0052973 | A1 * | 2/2009 | Windorski | B43K 29/12 401/195 |
| 2012/0091014 | A1 | 4/2012 | Jour | |

* cited by examiner

*Primary Examiner* — Jennifer C Chiang

(74) *Attorney, Agent, or Firm* — Global Intellectual Property Agency, LLC; Daniel Boudwin

(57) ABSTRACT

A sheet material dispenser is provided for a utensil item that allows a user to dispense individual sheets of material, such as adhesive notes, tape, or paper material, from the upper end of a writing utensil or similar tool. The device comprises one of a sheet material housing or support, whereby individual sheets are dispensed from the upper end of the utensil and the device remains connected to the utensil item while the utensil item is used. The housing comprises one of a rectangular or rounded housing with an elongated slot therealong to dispense individual sheets of material. The upper end of the housing is secured closed using an end cap. The sheet material support comprises a U-shaped assembly that supports a stack of exposed sheets for individual dispensation. The lower end of each device comprises an aperture adapted to secure to the upper end of the utensil.

3 Claims, 6 Drawing Sheets

SHEET MATERIAL DISPENSER FOR UTENSIL ITEM

CROSS REFERENCE TO RELATED APPLICATION

This application claims priority from and is a continuation application of U.S. patent application Ser. No. 14/695,635 filed on Apr. 24, 2015, which claims the benefit of U.S. Provisional Application No. 61/983,595 filed on Apr. 24, 2014, entitled "Writing Instrument With Attached Paper." The above identified patent applications are herein incorporated by reference in its entirety to provide continuity of disclosure.

BACKGROUND OF THE INVENTION FIELD OF THE INVENTION

The present invention relates to writing utensils and adhesive notes. More specifically, the present invention relates to a device for dispensing sheet material, such as adhesive notes, tape, or paper notes, from the upper end of a writing utensil or similar elongated tool. The device connects a writing utensil with common sheet stationary items for improved access to the stationary while writing or otherwise using the utensil.

It is common while writing, taking notes, or making markings to use various sheet material for various purposes. These include employing adhesive tape for a given project, placing an adhesive note in a desired location, or generally writing down notes on a small note for later inspection. The present invention contemplates a device that affixes to a utensil item, such as a writing utensil, a cutting tool, or other elongated, handheld tool, whereby the device supports sheet material along the upper end of the tool. Specifically, the sheet material is supported within one of a housing or a U-shape support such that individual lengths or sheets thereof can be removed from the device while maintaining a stack or roll thereof in connection with the utensil.

Many applications are contemplated, including adhesive notes being supported by a writing utensil, tape being supported by an elongated cutting tool, and many others. It is not desired to limit the type of sheet material that can be utilized nor is it desired to limit the specific type of utensil in connection with the device. Rather, it is desired to disclose a new and novel device for supporting sheet material in connection with a utensil item that improves access to the sheet material and does not interfere with normal operation of the utensil item.

SUMMARY OF THE INVENTION

The following summary is intended solely for the benefit of the reader and is not intended to be limiting in any way. The present invention provides a new sheet material dispenser that is affixable to the upper end of a utensil item, wherein the same can be utilized for dispensing sheets of paper, tape, adhesive notes, or similar sheet material from a device in connection with the utensil item.

It is another object of the present invention to provide a utensil attachment for storing and dispensing sheet material, comprising a sheet material housing comprising lower end, an upper end, one or more sidewalls, and an interior volume. The interior volume is adapted to support sheet material therein, while an elongated slot is disposed along one of the sidewalls for dispensing the sheet material therethrough and from the interior volume. The lower end of the sheet material housing comprises an aperture adapted to connect to an elongated utensil item.

Another object of the present invention is to provide a utensil attachment that comprises a sheet material housing having a pair of opposing sidewalls and a pair of opposing end walls. The pair of opposing sidewalls and the pair of opposing end walls form a substantially rectangular cross section, wherein the interior volume of the rectangular cross section is adapted to support a substantially rectangular stack of sheet material therein. The stack of sheet material further comprises individual sheets of material connected along adjacent edges thereof and individually dispensable from the stack.

Another object of the present invention is to provide a utensil attachment that comprises a sheet material housing having a rounded sidewall, wherein the rounded sidewall forms a substantially cylindrical cross section. The interior volume of the cylindrical cross section is adapted to support a substantially rounded roll of sheet material therein. The rounded roll of sheet material further comprises individual sheets of material connected along adjacent edges thereof and individually dispensable from the rounded roll.

Yet another object of the present invention is to provide a utensil attachment whereby upper end of the sheet material housing further comprises a removable cap that is adapted to enclose the interior volume and the sheet material therein.

Another object of the present invention is to provide a utensil attachment that comprises an elongated slot that extends along the sidewall from the lower end of the sheet material housing to the upper end of the sheet material housing. The elongated slot extends through the upper end of the housing such that the slot forms a gap along the perimeter of the upper end of the housing to receive an individual sheet of the sheet material through the gap when inserting the sheet material through the upper end and into the interior volume.

Another object of the present invention is to provide a utensil attachment that comprises an aperture along the lower end of the sheet material housing that further comprises a threaded interior surface adapted to threadably secure to a threaded upper end of the utensil item.

Another object of the present invention is to provide a utensil attachment that comprises a housing or attachment that is adapted to affix to a writing utensil, elongated tool, or other utensil item.

Another object of the present invention is to provide a utensil attachment that attaches to a utensil item that comprises a writing end with an upper end that is adapted to be received within the aperture of the sheet material housing.

Another object of the present invention is to provide a utensil attachment that comprises a sheet material support member having a U-shaped cross section with a lower member and a pair of upstanding members. The sheet material support member is adapted to support a stack of sheet material, whereby the lower surface of the sheet material support member further comprising an aperture adapted to connect to an elongated utensil item.

Another object of the present invention is to provide a utensil attachment that comprises a sheet material support member for supporting a stack of sheet material, wherein the stack of sheet material comprises a lower end adapted to be received between the pair of upstanding members of the U-shaped cross section of the support and supported therebetween. The stack of sheet material is substantially exposed above the pair of upstanding members and comprises individual sheets of material that are removably connected to the lower end of the stack along perforated lines of connection.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
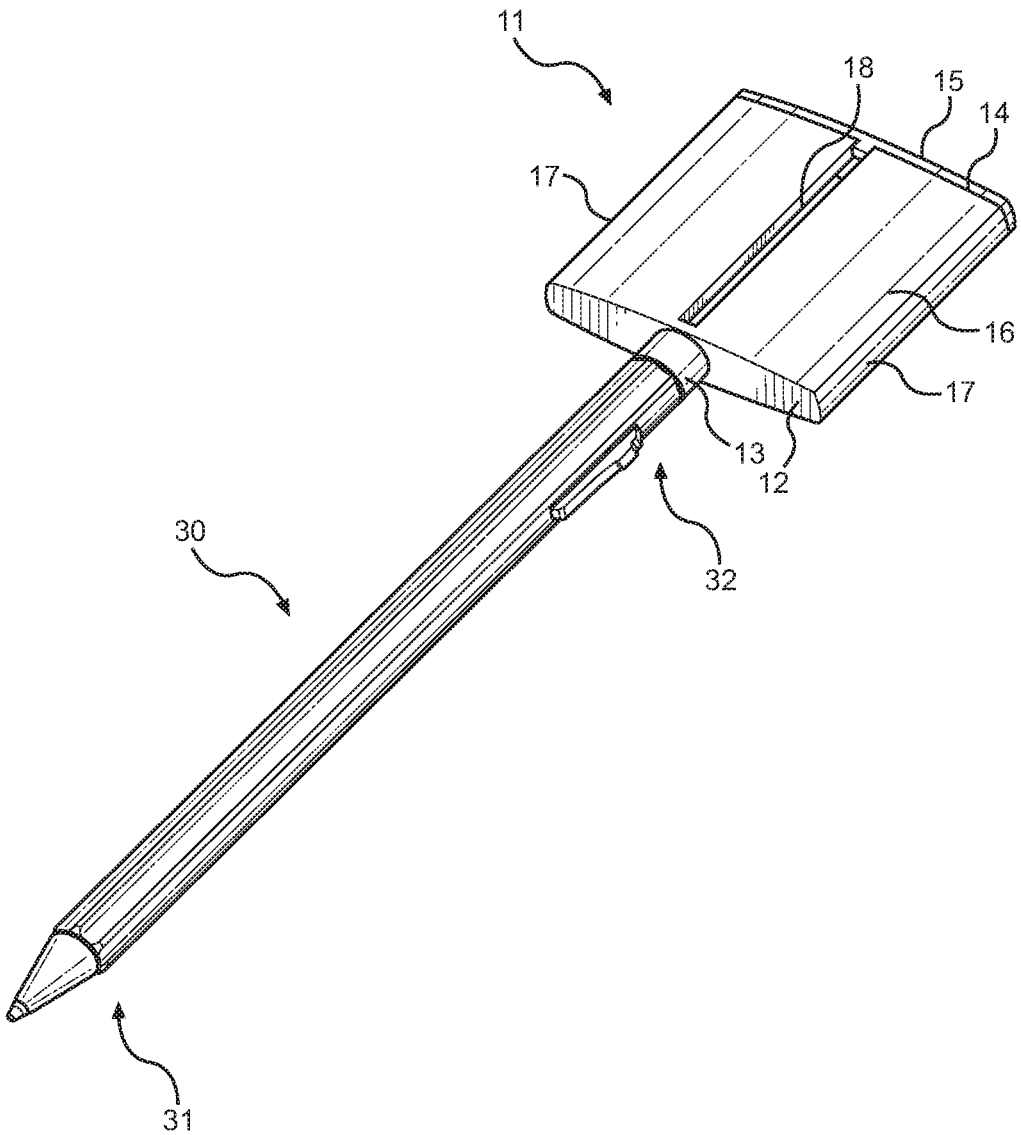
FIG. 1 shows a perspective view of an embodiment of the utensil attachment of the present invention and one contemplated utensil attachment item.

Reference is made herein to the attached drawings. Like reference numerals are used throughout the drawings to depict like or similar elements of the utensil attachment of the present invention. For the purposes of presenting a brief and clear description of the present invention, the preferred embodiment will be discussed as used for supporting sheet material in connection with a utensil item. The figures are intended for representative purposes only and should not be considered to be limiting in any respect.

Figure 2:
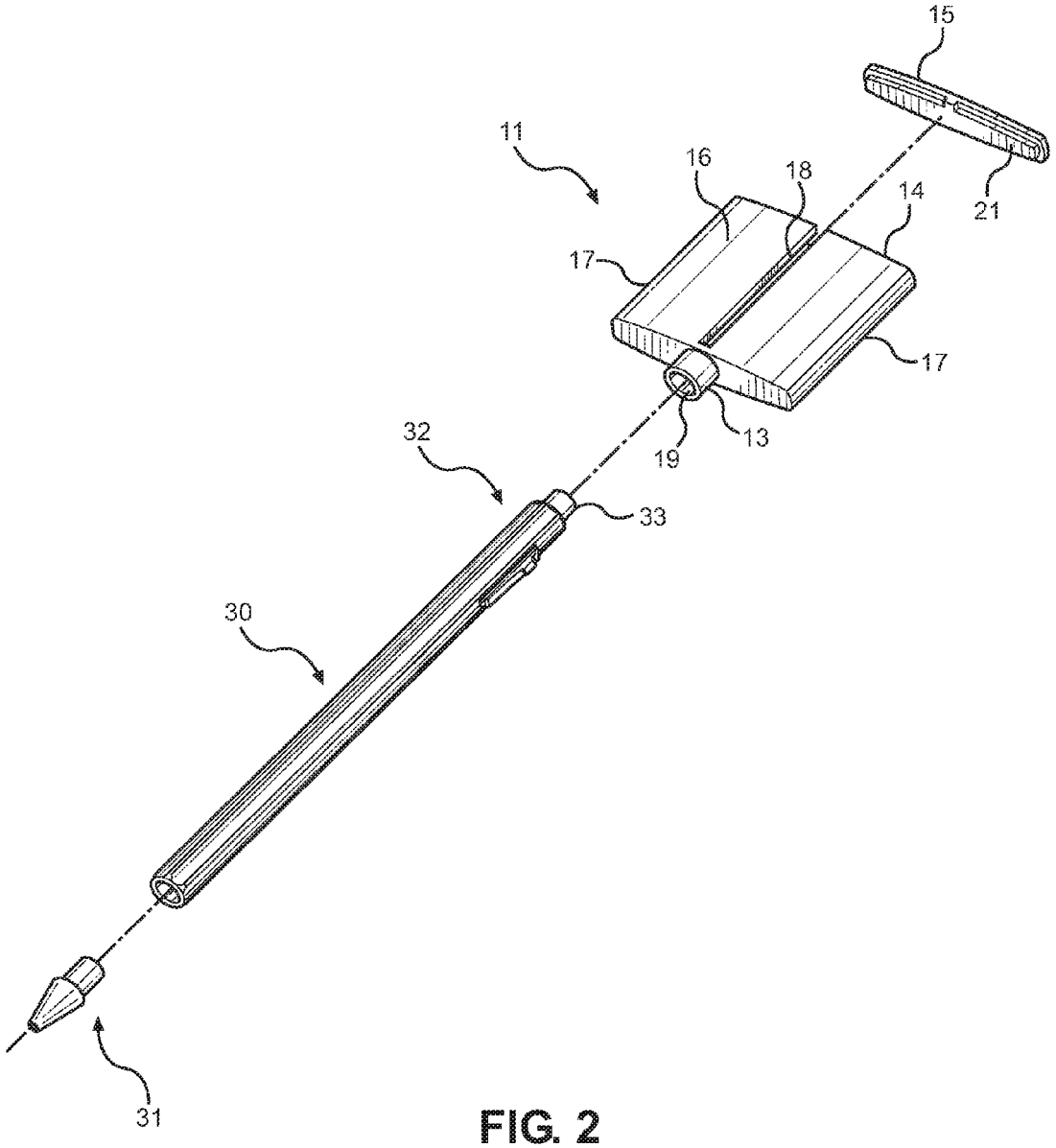
FIG. 2 shows an exploded view of an embodiment of the utensil attachment of the present invention and one contemplated utensil attachment item.
Figure 3:
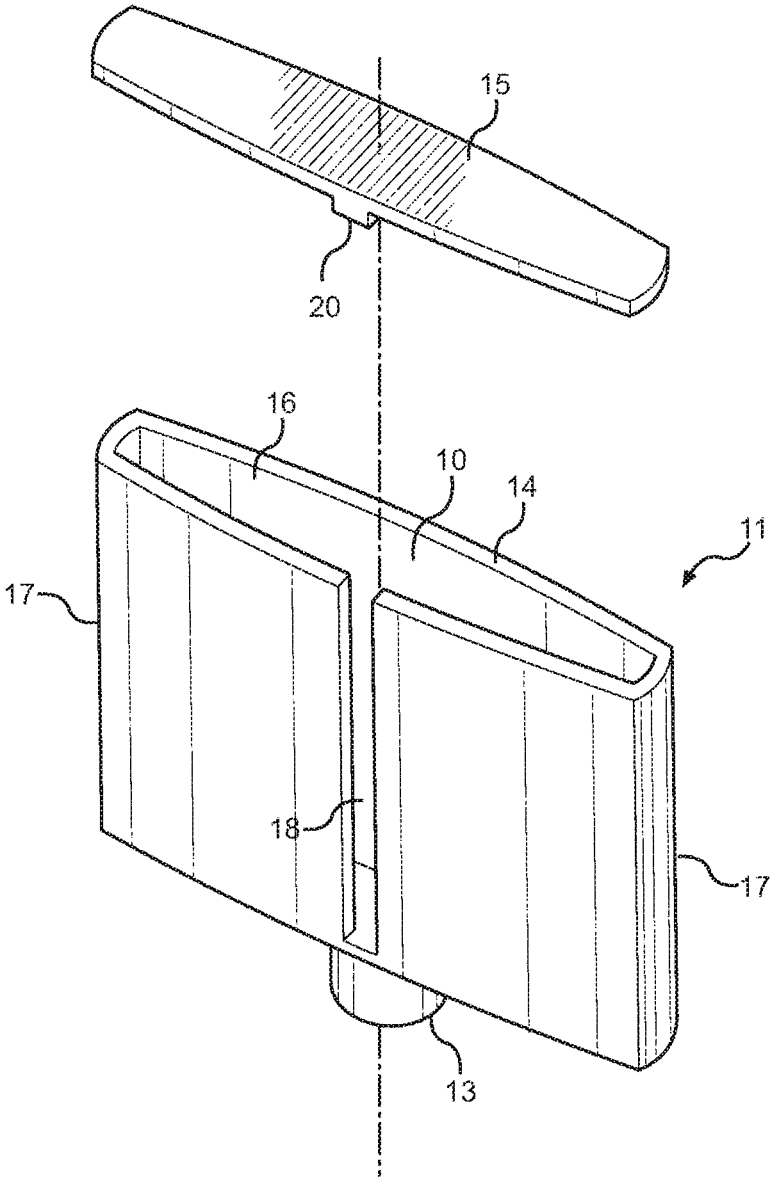
FIG. 3 shows an exploded view of the rectangular sheet material housing, whereby the end cap is separated from the upper end of the housing.

Referring now to FIGS. 1-3, there are shown views of an embodiment of the utensil attachment of the present invention. The utensil attachment comprises a device that supports a stack or roll of sheet material in connection with a utensil, whereby ready access to the sheet material is provided to the user while the utensil item remains operable and unencumbered by the device. The sheet material is one of several useful items that are dispensed individually or in elongated sheets for various purposes. Many different types of sheet material are contemplated, including paper products, adhesive tape, adhesive notes, and other sheet material. The utensil item 30 of the present invention may be one of a writing utensil (e.g. a pencil, pen, or marker), or alternatively the utensil may be a different tool (e.g. a cutting tool or the like). The device of the present invention connects to the upper end 32 of the utensil item 30 and secures thereto while the working end 31 of utensil item 30 is unaltered and useful for its intended function. The device provides a dispenser for the sheet material from the end of the utensil item 30 when desired.

The utensil attachment device comprises sheet material housing 11 having a lower end 12, an upper end 14, one or more sidewalls 16, and an interior volume. The lower end 12 includes an aperture 13 that is adapted to connect to the upper end 32 of the utensil item 30. The interior volume of the housing 11 is adapted to support sheet material, which is placed through the upper end 14 of the housing and dispensed through an elongated slot 18 disposed along one of the sidewalls 16 of the housing 11.

In one embodiment of the present invention and as shown in FIGS. 1-3, the utensil attachment device comprises a sheet material housing 11 having a substantially rectangular cross section. The housing 11 comprises a pair of opposing sidewalls 16 and a pair of opposing end walls 17 to form the rectangular cross section. The rectangular housing 11 has an interior volume that is adapted to support a substantially rectangular stack of sheet material therein, wherein the stack of sheet material further comprises individual sheets of material connected to one another along a pair of adjacent edges. The sheet of material is dispensed through the elongated slot 18, whereby each sheet is partially exposed and pulled through the slot individually. The connection between adjacent sheets pulls a subsequent sheet of material through the slot 18 when the exposed sheet is withdrawn, thereby placing the subsequent sheet in the exposed position for the user to withdrawal the next sheet of material. In this way the sheets are individually dispensable from the stack, but connected along opposing edges to ensure subsequent sheets are available for withdrawal through the slot 18 as each is dispensed.

The housing 11 includes an open upper end 14 that is adapted to receive the sheet material therethrough, whereby the sheet material is placed within the interior volume of the housing. To facilitate removal of the first sheet material from the stack once placed into the housing interior, the uppermost sheet is placed through the slot 18 as the stack is inserted into the housing 11. The elongated slot 18 therefore preferably extends from the lower end 12 of the housing to the upper end 14 of the housing, whereby the slot 18 extends through the upper end 14 and forms a gap 10, or discontinuity, along the perimeter of the upper end 14. This allows the first sheet material to be exposed from the stack and inserted through the gap 10 as the stack is inserted through the open upper end 14 and into the housing interior.

Disposed over the open upper end 14 of the housing 11 is an end cap 15. The end cap 15 secures over the upper end 14 of the housing and encloses the sheet material within the interior volume thereof, preventing the same from exiting the housing once inserted thereinto. The end cap preferably comprises an elongated surface with a lower protruding portion 21 that partially inserts into the housing interior volume. The protruding portion 21 is not completely coextensive with the end cap 15, but rather shares the same area as the cross section of the internal volume of the housing. The surface of the end cap forms a shoulder, whereby the protruding portion 21 extends into the housing and the surface of the cap is flush against the upper end 14 of the housing. A portion 20 of the protruding portion 21 may also be present that aligns with the elongated slot 18 in the housing to enclose the slot 18 along its upper end.

Figure 4:
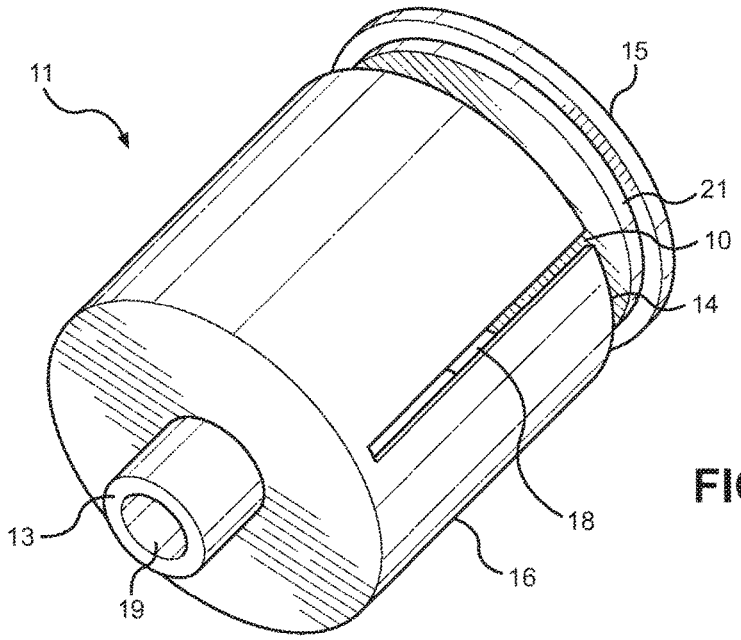
FIG. 4 shows an exploded view of the rounded embodiment of the sheet material housing, whereby the end cap is separated from the upper end of the housing.
Figure 5:
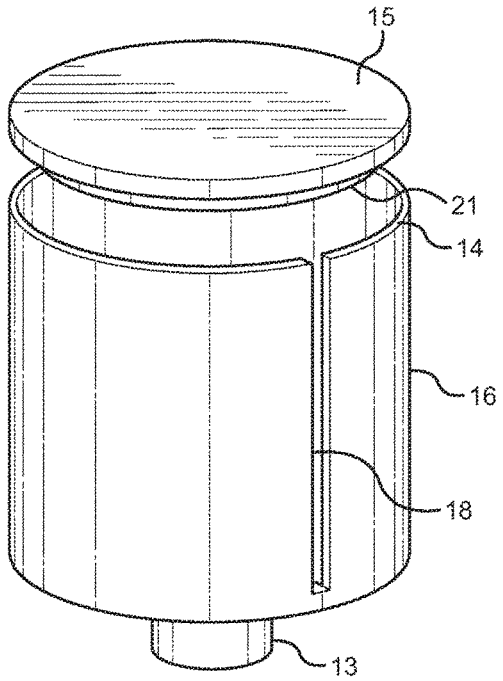
FIG. 5 shows another exploded view of the rounded embodiment of the sheet material housing, whereby the end cap is separated from the upper end of the housing.

Referring now to FIGS. 4 and 5, there are shown views of an embodiment of the sheet material housing 11 of the present invention. In this embodiment, the sheet material housing 11 comprises a rounded sidewall 16 such that the housing 11 forms a substantially cylindrical cross section. The rounded housing 11 has an interior volume that is adapted to support a substantially rounded roll of sheet material therein, wherein the rounded roll of sheet material comprises individual sheets of material connected along adjacent edges thereof and individually dispensed from the rounded roll. The roll of sheet material is disposed through an elongated slot 18 through the rounded sidewall 16 of the housing 11, while the roll is placed through the open upper end 14 of the housing to load the housing 11. Similar to the rectangular embodiment, the rounded embodiment includes a lower end having a utensil aperture 13 and an open upper 14 adapted to be enclosed by an end cap 15. The end cap 15 of the rounded embodiment may also have a protruding portion 21 that is received by the upper end 14 of the housing, while the elongated slot 18 of the housing may also extend through the upper end 14 in a similar fashion.

The lower end of the housing in each embodiment comprises an aperture 13 adapted to connect to the upper end of a utensil item. In a preferred configuration, the aperture 13 is disposed within a projection extending from the lower end of the housing. The projection is either received or receives the utensil, connecting the housing 11 to the utensil item. In one embodiment, the projection comprises a threaded interior surface 19 that threadably affixes to a threaded upper end of a utensil item. In other embodiments, the exterior surface of the projection is threaded, and the projection is received within the upper end of the utensil item. It is not desired to limit the present invention to the exact configuration of this connection; rather it is desired to disclose a connection between the utensil upper end and the housing. The connection is preferably a removable connection that can be removed by the user; however, embodiments are contemplated in which the utensil item and the housing are a combination device, permanently affixed and not meant to be separated.

Figure 6:
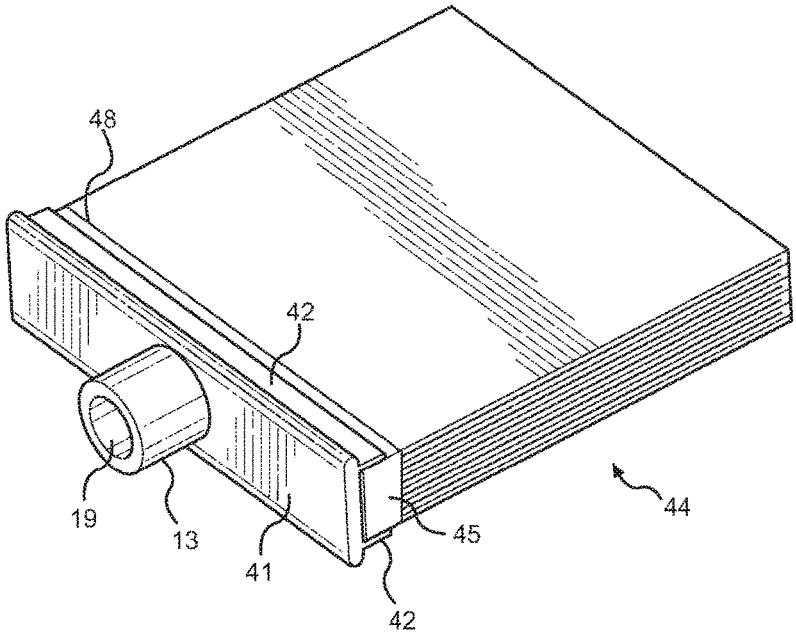
FIG. 6 shows a view of the U-shaped sheet material support member supporting a stack of sheet material therein.
Figure 7:
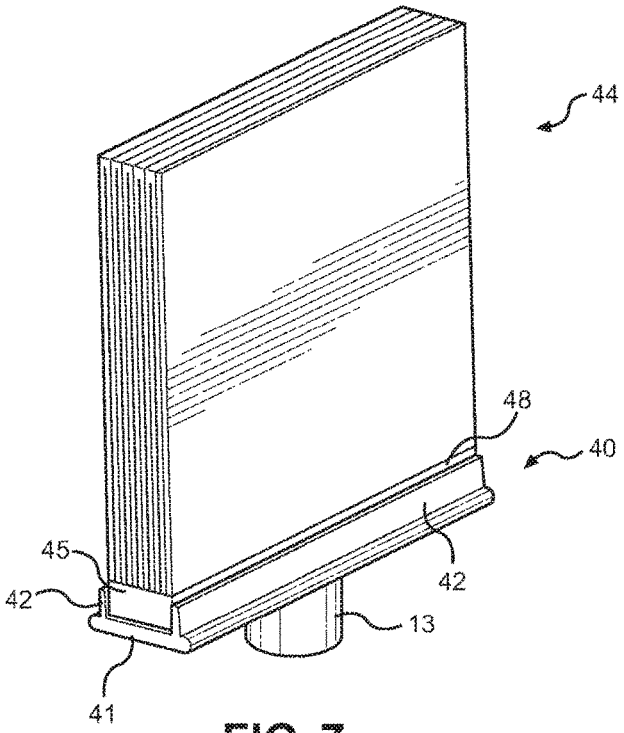
FIG. 7 shows another view of the U-shaped sheet material support member supporting a stack of sheet material therein.

Referring now to FIGS. 6-7, there are shown views of another embodiment of the present invention. In this embodiment, a stack 44 of sheet material is supported by a sheet material support member 40 having a U-shaped cross section that supports the base of the stack 44. The support member comprises a lower member 41 and a pair of upstanding members 42 that form the U-shaped configuration. The lower surface of the sheet material support member further comprises a utensil aperture 19 and optional projection that is adapted to connect to an elongated utensil item. This embodiment supports a stack 44 of sheet material along its lower end, whereby a majority of the sheet material is exposed from the support member 40 and accessible individually by the user.

This embodiment supports a stack 44 of sheet material along its lower end 45, whereby a majority of the sheet material is exposed from the support member 40 and accessible individually by the user. The stack 44 comprises a lower end 45 adapted to be received between the pair of upstanding members 42 and supported therebetween, whereby the stack 44 of sheet material is substantially exposed above the pair of upstanding members 42 and comprises individual sheets of material that are removably connected to the lower end of the stack along perforated lines of connection 48 with the lower end 45 of the stack. In this manner, individual sheets are removed from the stack by tearing the sheets away from the stack along the line of connection 48, whereby the lower end 45 remains affixed to the support.

Figure 8:
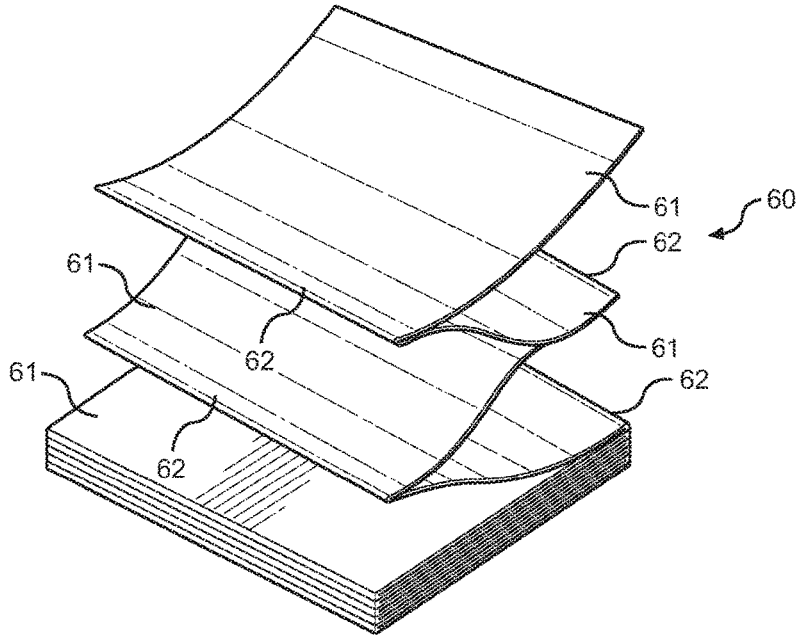
FIG. 8 shows a representative view of a stack of sheet material contemplated as function in combination with the rectangular sheet material housing of the present invention.
Figure 9:
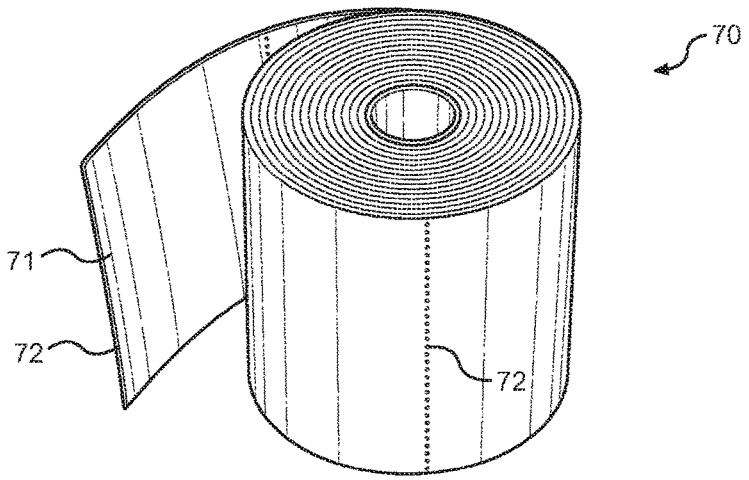
FIG. 9 shows a representative view of a rounded roll of sheet material contemplated as function in combination with the rounded sheet material housing of the present invention.

Referring finally to FIGS. 8 and 9, there are shown exemplary examples of the sheet material contemplated for use in conjunction with the utensil attachment of the present invention. Contemplated sheet material includes paper products, adhesive tape, adhesive note paper, or the like. In a stacked configuration 60 as presented in FIG. 8, each sheet 61 is connected to a subsequent sheet 61 along one edge 62. Adhesive between the sheets 61 and between the adjacent edges 62 allow the uppermost sheet to be withdrawn and simultaneously move the next adjacent sheet into the position vacated by the uppermost sheet. This allows one sheet to be partially exposed through the elongated slot of the utensil attachment for removal of subsequent sheets by the user.

In rolled form and as shown in FIG. 9, the sheet material forms a rolled configuration 70 in which an elongated sheet of material is placed within the utensil attachment housing. The roll form 70 is suitable for the rounded embodiment, whereby a first sheet 71 of the roll is exposed through the elongated slot and each sheet 71 is connected to another sheet in the roll 70. Specifically, the sheets are connected along their edges 72 to adjacent sheets in the roll 70 using a perforated line of connection that is severable by user force, or alternatively using a razor cutting disposed along the elongated slot of the housing. The exposed sheet 71 is withdrawn, thereby moving the next subsequent sheet into the vacated position of the withdrawn sheet.

Overall, the present invention provides a new and useful dispensing device for sheet material in connection with a utensil item. It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claimed invention.

I claim:

1. A utensil attachment for storing and dispensing sheet material, comprising:

a sheet material support member having a U-shaped cross section comprising a lower member and a pair of upstanding members;

the sheet material support member being adapted to support a stack of sheet material;

a protrusion having a first end and a second end, wherein the first end is directly secured to the lower end of the sheet material housing and extends perpendicularly therefrom;

an aperture disposed on the second end of the protrusion, wherein the aperture is adapted to connect to an elongated utensil item;

wherein the stack of sheet material comprises a lower end adapted to be received between the pair of upstanding members and supported therebetween, whereby the stack of sheet material is substantially exposed above the pair of upstanding members and comprises individual sheets of material that are removably connected to the lower end of the stack along perforated lines of connection.

2. The utensil attachment of claim 1, wherein the aperture along the lower end of the sheet material support member further comprises a threaded interior surface adapted to threadably secure to a threaded upper end of the utensil item.

3. The utensil attachment of claim 2, wherein the utensil item further comprises a writing utensil with a writing end and an upper end that is adapted to be received within the aperture of the sheet material support member.

* * * * *